United States Patent [19]

Shattes et al.

[11] Patent Number: 4,846,267

[45] Date of Patent: Jul. 11, 1989

[54] ENHANCED HEAT TRANSFER SURFACES

[75] Inventors: Walter J. Shattes, Bloomfield; Nikhiles Bandyopadhyay, Somerset; Paul C. Krueger, Warren, all of N.J.

[73] Assignee: The BOC Group, Inc., Murray Hill, N.J.

[21] Appl. No.: 168,035

[22] Filed: Mar. 14, 1988

Related U.S. Application Data

[62] Division of Ser. No. 32,671, Apr. 1, 1987, Pat. No. 4,767,497.

[51] Int. Cl.[4] ..... F28F 13/00

[52] U.S. Cl. ..... 165/133; 428/148

[58] Field of Search ..... 165/133; 428/141, 143, 428/148

[56] References Cited

U.S. PATENT DOCUMENTS

| | | | |
|---|---|---|---|
| Re. 30,077 | 8/1979 | Kun et al. . | |
| 2,658,845 | 11/1953 | Barker . | |
| 3,236,706 | 2/1966 | Kuchek . | |
| 3,384,154 | 5/1965 | Milton . | |
| 3,523,577 | 8/1970 | Milton | 165/133 X |
| 3,615,900 | 10/1971 | Lee . | |
| 3,696,861 | 10/1972 | Webb . | |
| 3,990,862 | 11/1976 | Dahl et al. | 165/133 X |
| 4,018,264 | 4/1977 | Albertson . | |
| 4,216,819 | 8/1980 | Notaro . | |
| 4,232,056 | 11/1980 | Grant et al. . | |
| 4,258,783 | 7/1981 | Albertson et al. . | |
| 4,359,086 | 11/1982 | Sanborn et al. . | |
| 4,360,058 | 11/1982 | Muellenjans . | |
| 4,663,243 | 5/1987 | Czikk et al. | 165/133 X |

OTHER PUBLICATIONS

Bonilla, et al., Chem. Eng. Prog. Symp. Series, vol. 61, No. 57, (May 1965), pp. 280–288.

Benejamin, et al., International Developments in Heat Transfer, ASME, New York, (Jun. 1961), pp. 212–218.

Vachon, et al, Journal Heat Transfer, vol. 90, No. 7, (Jul. 1968), pp. 239–247.

Martin Petro/Chem Engineer, (Apr. 1970), pp. 30 & 32.

Kurihara et al, A.I.Ch.E. Journal, vol. 6, No. 1, (May 1960), pp. 83–91.

Webb Heat Transfer Engineering, vol. 2, Nos. 3–4, (Jan.–Jun. 1981), pp. 46–48.

*Primary Examiner*—Margaret A. Fogarino

*Attorney, Agent, or Firm*—Carol A. Nemetz; R. Hain Swope; L. R. Cassett

[57] ABSTRACT

Aluminum alloys suitable for fabrication into plate and fin type heat exchangers are subjected to a chemical etching procedure in order to improve the heat transfer efficiency thereof. Applicants have found that a high temperature heat treatment of an aluminum alloy plate material to produce a precipitate, followed by exposure to an etching composition, results in a heat exchanger surface modified by the formation of pits. The heat exchangers so modified may be advantageously used in the reboiler/condensor section of air separation units.

3 Claims, 2 Drawing Sheets

ENHANCED HEAT TRANSFER SURFACES

This is a division of application Ser. No. 032,671 filed Apr. 1, 1988, now Pat. No. 4,767,477.

BACKGROUND OF THE INVENTION

The present invention relates to the enhancement of the heat transfer properties of surfaces used in heat exchangers. Applicants have found that by a novel chemical etching procedure, the formation of a particular surface topography will enhance the heat transfer properties exhibited by various heat exchangers.

The development of high performance nucleate boiling surfaces for commercial use in heat exchangers has been the focus of considerable industrial research efforts over the last several decades. Proposed techniques for promoting nucleate boiling include the following:

(1) Abrasive treatment—Abrasively roughening the surface of a plate will at least temporarily improve nucleate boiling, a phenomenon that has been known for many years.

(2) Inscribing often grooves—Forming parallel grooves by sharp pointed scribes, with a scratch spacing of 2 to 2.5 bubble diameters was found to increase the boiling coefficient of a copper plate, as reported by Bonilla, C.F. et al. in "Pool Boiling Heat Transfer From Grooved Surfaces", Chem. Eng. Prog. Supp. Ser., vol. 61, No. 57, pp 280–288 (1965).

(3) Forming three dimensional cavities—Pressing cylindrical or conical cavities into a copper surface was found to significantly enhance boiling performance. It was found that the "re-entrant" type cavities were superior as a vapor trap. See, for example, Benjamin, J.E. et al., "Possible Growth in Nucleate Boiling a Binary Mixture", International Developments in Heat Transfer, ASME, New York, 1961, pp 212–218.

(4) Electroplating—Electroplating layers of certain coating materials such as copper at very high current densities, causing the formation of a porous coating on the surface, was disclosed on producing a large heat transfer increase in U.S. Pat. No. 4,018,264 issued to Albertson in 1977.

(5) Chemical etching—Exposing the surface of a wall to an etching bath for a short period of time was found to substantially improve the heat transfer properties of the wall, as disclosed in U.S. Pat. No. 4,360,058 issued to Muellejans in 1982.

None of the prior art approaches to enhancing heat transfer performance is fully satisfactory. For example, the formation of discrete cavities by mechanical treatment is difficult and expensive. Furthermore, mechanical treatment as well as electroplating may be impractical on thin metal walls. Furthermore, mechanical treatment is generally not amenable to the relatively inaccessible walls of plate and fin heat exchangers.

Heat transfer enhancement is especially desirable in the reboiler/condenser system of a conventional air separation plant, which involves boiling oxygen at low pressure on one side of an aluminum divider and condensing nitrogen at high pressure on the other side. The efficiency of such a system is limited by the heat transfer between the aluminum divider and the boiling oxygen. An improvement in heat transfer would result in savings in energy costs by reducing the pressure requirements for the nitrogen or in initial equipment costs by reducing the dimensions of the system.

It is therefore a principal object of the present invention to enhance the heat transfer of a heat exchanger surface by the formation of a surface topography which promotes rapid and stable nucleate boiling.

It is yet another object of the present invention to enhance the heat transfer properties of a heat exchanger surface utilizing a chemical etching process which is simple and economical.

It is a further object of the present invention to promote nucleate boiling without the necessity of highly involved or expensive mechanical treatment which cannot be applied to inaccessible walls.

It is a further object of the present invention to facilitate heat transfer during the phase change of a fluid, for example, during cryogenic distillation of a permanent gas.

It is yet a further object of the present invention to enhance the heat transfer properties of a heat exchange surface when boiling liquids of low surface tension such as cryogenic nitrogen or oxygen.

It is yet a further object of the invention to enhance the heat transfer properties of a heat exchange surface in contact with water or refrigerants such as freon or ammonia.

It is yet another object of the invention to accomplish a process for enhancing the heat exchange properties of a surface which is practical for plate and fin type heat exchangers, for example, the inner or outer surface of a shell and tube heat exchanger.

It is a further object of the invention to improve heat exchangers by procedures compatible with existing fabrication processes.

DETAILED DESCRIPTION OF THE INVENTION

Figure 1A:
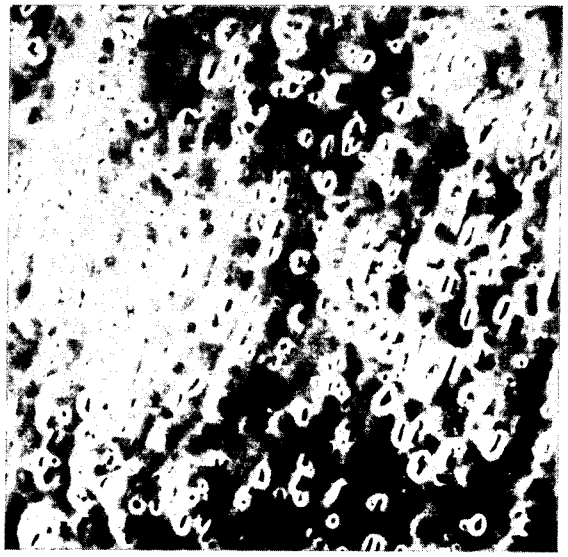
FIG. 1 is a scanning electron photomicrograph of an enhanced heat transfer surface of aluminum alloy 3003 at (a) 500× magnification and (b) 1000× magnification.

A procedure is disclosed for the formation of a surface topography on a thin aluminum structure that will provide an effective number of bubble nucleation sites so as to significantly enhance its heat transfer properties. In brief, this is accomplished by two basic steps: (1) the formation of a precipitate in the aluminum structure, and (2) the controlled and preferential dissolution of said precipitate by chemical dissolution such that pits are formed on the surface to be enhanced, which pits can act as bubble nucleation sites for the boiling of a liquid.

A precipitate may pre-exist in the alloy or can be formed in the aluminum structure by suitably heating the structure at an elevated temperature for a sufficient period of time. A suitable temperature range is 900° F. to 1200° F., preferably about 1100° F. A suitable heating period is 10 to 60 minutes, preferably about 30 minutes. The aluminum structure is preferably cooled in air or water quenched at ambient temperature.

It is believed that the precipitate formed in the above described heat treatment is the product of the reaction of aluminum, iron, manganese, or silicon atoms that are contained in solution in the aluminum alloy crystal structure. The precipitated compounds may be formed throughout the metal structure, but it is the precipitates near the surface that are of concern to the present invention. The aluminum metal typically contained greater than 98 percent aluminum. Although there is little certainty or knowledge concerning the exact composition of the precipitates formed, they are believed to include $(Mn)Fe_3SiAl_{12}$, $Fe(Mn)Al_6$ and the like. The chemical nature of the precipitates is in general not critical, but rather it is the size, density and shape of the pit which is formed in the precipitate layer which is important in determining properties such as the amount of superheat needed to initiate boiling and the stability once boiling has begun.

The heat treated aluminum structure is subsequently exposed to an etching composition for a period of at least 5 to 10 minutes. The surface may be chemically or electrolytically etched. A suitable etching composition may be acidic solutions of sufficient strength. The preferred etching composition is an aqueous solution of concentrated nitric acid, concentrated hydrochloric acid, and concentrated hydrofluoric acid.

By the reaction of the corrosive etching composition, pits are formed by removal or dissolution of the precipitate on or near the aluminum structure. The exposure of the etching composition to the surface to be enhanced is adjusted to control the amount and nature of the pitting. It has been found that pits of two size categories may be formed in an etching process: (1) pits of a submicron size and (2) and pits of approximately one to several microns of size. The submicron pits are in general undesirable.

It is important to obtain pits of an average size range of 0.5 to 5 microns in average diameter, most effectively in the range of 1 to 5 microns, and most preferably in the range of 1 to 2 microns (0.05 to 0.08 mils). The density of pits are suitably in the range of $10_4$ to $10_6$ per square centimeter, and most preferably on the order of $10_6$ per square centimeter. As explained in detail in Example I, the formation of background parts of a smaller average diameter adversely affects the heat transfer enhancement and should therefore be avoided by controlling the heat treatment temperature and/or the etching time.

A microscopic examination can be used to distinguish between a surface having the type of pits desired and a non-enhanced surface. Furthermore, such an examination can provide a means to optimize process parameters.

The explanation for the effect of pit size and its effect on the mechanism of nucleate boiling can only be theorized. However, it is surmised that the micron sized pits permit the bubbles to be easily and quickly released from the surface, whereas the submicron pits tend to aggregate and form larger bubbles that take longer to be released. Since the surface pits shown responsible for enhancement are at least an order of magnitude too small to be explained by the re-entrant cavity mechanism, some cooperative process between pits may be occurring.

The pitted surfaces of the present invention are particularly effective with respect to the boiling of a cryogenic liquid such as nitrogen or oxygen. The low surface tension of these liquids may account for the enhanced effect of the etching. It is noted that Vachon, R.E. et al. in "Evaluation of Constants for the Rohnsenow Pool - Boiling Correlation, J. Heat Transfer", vol. 90, pp 239–247 (1968), previously reported that boiling water on a chemically etched stainless steel surface showed no better performance than a polished surface.

The aluminum substrate used for the enhanced surface is preferably Al 3003. Other Aluminum alloys such as Al 7075 may not require heat treatment just prior to etching. Sufficient precipitate may have been formed in normal manufacturing procedures of the aluminum. This tends to be the case with "dirty" or more highly alloyed aluminum. SimilarlY. sufficient precipitate may have been formed in the Al 3003 during the shaping or bending of a flat plate into a heat exchanger configuration.

EXPERIMENTAL APPARATUS

An experimental apparatus for Examples I through V was constructed as follows to test the aluminum pieces for heat transfer enhancement. Heat transfer between a metal surface and a liquid can be described in terms of the heat transfer coefficient (h) defined as $$[h=(Q/A)/\Delta T]$$

where Q/A is the heat flux (in watts) through the surface (in square centimeters) and $\Delta T$ (in ° C.) is the temperature difference between the metal surface and the saturation temperature of the liquid in contact with that surface. Although Q/A and $\Delta T$ are the parameters measured in the tests, $\Delta T$ is used generally to describe the relative efficiency of heat transfer. $\Delta T$ should be a minimum at a given heat flux if good heat transfer is achieved.

The experimental apparatus used to measure Q/A and $\Delta T$ between test metal surfaces and boiling nitrogen under constant heat flux conditions included a strip heater (Minco model HK 5335 R4.1 L12A) which was bonded to the back of an aluminum test piece using a thermally conductive grease (CRYO-CON). Each aluminum test piece was six inch long by $1\frac{1}{2}$ inch wide and $\frac{1}{4}$ inch thick and eight thermocouple wells to hold one leg or junction of a differential copper-constantan thermocouple were drilled laterally half way into the test piece sidewall along the length of the test piece. The second junction was placed in the boiling nitrogen. The test piece was placed in a fiber-glass reinforced epoxy fixture that allowed only a 6 inch long by 1 inch wide surface of the metal to be exposed to liquid nitrogen. This assembly was sealed with a room temperature vulcanizing silicone sealant (RTV adhesive sealant manufactured by General Electric). The entire apparatus with inserted thermocouples was immersed in a strip-silvered Dewar flask (20 inch high with an inside diameter of 6 inch) filled with liquid nitrogen.

With this test apparatus, heat supplied to the test piece from the heater flows uniformly through the metal test piece to the liquid nitrogen. Q was calculated from measurements of applied voltage read on the voltmeter of the Trygon Electronic Model RS-40-10 DC power supply and current to the heater measured with a Sensitive Research Instrument Corp. Type N ammeter. The variable A in formula I above is the exposed area of the metal surface in contact with the boiling liquid nitrogen. The exposed area was set by the opening in the test rig. The differential thermocouples provide $\Delta T$ measurements at up to eight different locations along the length of the test piece. Thermocouple voltage measurements were made with a Hewlett Packard model 3478A multimeter.

The validity of the experimental procedure required the following assumptions: (1) at equilibrium, all heat from the strip heater flows through the test piece to the liquid nitrogen; (2) the heat flux through the test piece was uniform; (3) there is a negligible temperature difference between the position of the thermocouple (approximately 1/8 inch below the test piece surface) and the test piece surface.

To eliminate transitory effects from the experimental results, measurements were taken after the test pieces had been "aged" for approximately 24 hours. The aging process consisted of maintaining a constant heat flux through the test piece of 0.4 watts/cm$^2$, a typical value of heat flux in an ASU reboiler/ condenser system. By measuring $\Delta T$ on test pieces with constant heat input for times up to 96 hours, it was confirmed that equilibrium was reached within 24 hours. In addition, since some test pieces showed slight hysteresis effects, i.e. different values of $\Delta T$ for increasing versus decreasing heat flux, all test pieces were subjected to a high heat flux of about 0.9 watts/cm$^2$ for approximately 10 minutes which was then lowered to 0.4 watts/cm$^2$ in order to provide a consistent condition before aging.

EXAMPLE I

Heat Treated and Acid Etched Test Pieces

A test piece of aluminum alloy 3003 material (later designated test piece "O") was heat treated at 1000° F. for 20 minutes and cooling stepwise 50° F./30 min. to produce precipitates which were preferentially dissolved from the matrix using a solution mixture of 70% $HNO_3$, 40 ml; 37% HCl, 40 ml; 49%HF, 5–10 ml; and water, 800 ml for 17 hours. The resulting pitted surface showed about a 30% enhancement in heat transfer efficiency. It was found that these results could not always be reproduced in other heats of aluminum alloy 3003. Test pieces from six heats were evaluated following the heat treatment and etching procedure described above; three showed enhanced heat transfer and three showed little.

Figure 1B:
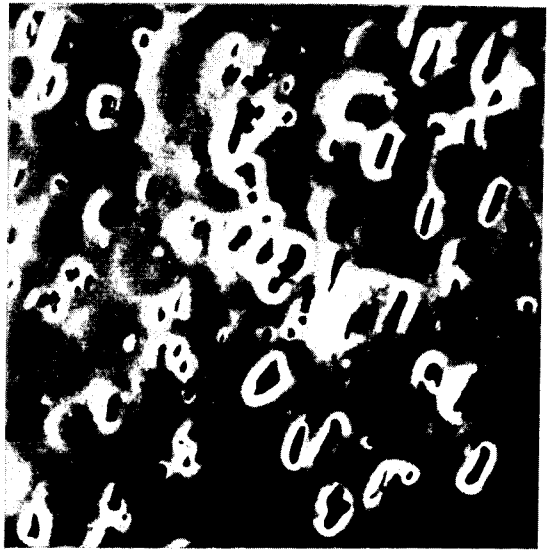
Figure 2A:
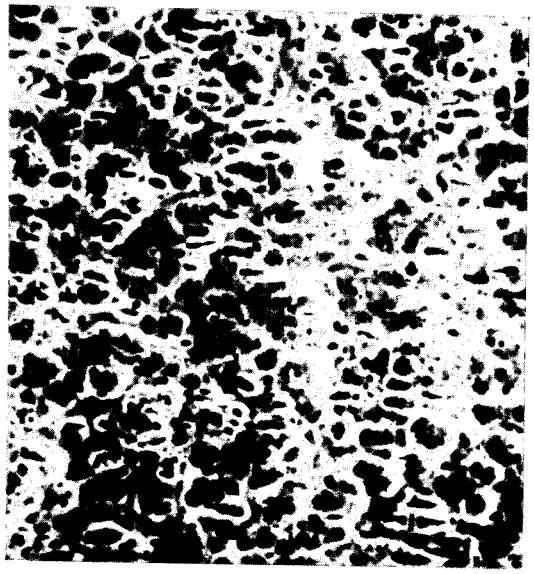
FIG. 2 is a scanning electron photomicrograph of a non-enhanced heat transfer surface of aluminum alloy 3003 at (a) 500× magnification and (b) 1000× magnification.
Figure 2B:
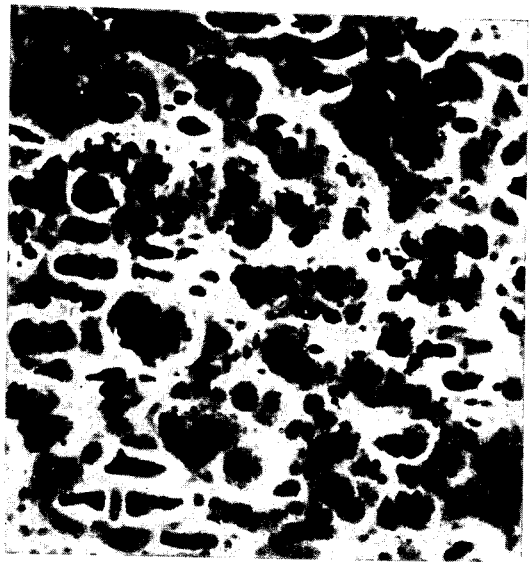

In an effort to understand this anomalous behavior, analyses of both bulk and surface chemistries of the test pieces were made as well as an investigation of the surface topography using a scanning electron microscope (SEM). Microscopic examination of the etched surfaces revealed that the enhanced test pieces had a surface density of about $10^6$ micron-size pits/cm$^2$ as shown in FIG. 1. The test pieces showing little enhanced behavior had similar numbers of these pits and, in addition, had large numbers of small sub-micron background pits as shown in FIG. 2. Further investigation revealed that these small background pits were created by the dissolution in the etch of small precipitates which were formed during the original metal fabrication procedure. It was found that the presence of these small background pits inhibited the enhanced heat transfer behavior.

In an effort to reduce the number of small background pits, an examination of both the heat treatment and etching procedures was made. It was found that a higher temperature heat treatment (1100° F.) would dissolve many of the small process precipitates into the matrix and, when followed by a water quench, the precipitates would not reform. It was also found that an etching time of 10 to 15 minutes in the acid solution produced surfaces with fewer small background pits. Results on test pieces from eight different heats of aluminum alloy 3003 that had been heat treated at 1100° F. for 1/2 hour, water quenched, and etched for 10 minutes in the previously described acid solution (hereafter referred to as dilute mixed acid) are given in Table I below. Heat flux for these data was 0.4w/cm$^2$. All test pieces exhibited an enhancement in heat transfer property of from 34 to 41%.

TABLE I

Heat Transfer Enhancement of Aluminum Alloy 3003 Test Pieces Solution Heat Treated at 1000° F. for ½ Hour - Water Quenched and Etched in Dilute Mixed Acid Solution for 10 Minutes

| Heat No. | 0 | 1 | 2 | 3 | 4 | 5 | 6 | 7 |
|---|---|---|---|---|---|---|---|---|
| Thermocouple | $\Delta T$ at 0.4 W/cm$^2$ | | | | | | | |
| 1 | 0.80° C. | 0.76° C. | 0.37° C. | 0.62° C. | 1.0° C. | 0.89° C. | 0.67° C. | 0.74° C. |
| 2 | 0.84 | 1.1 | 0.94 | 0.92 | 1.1 | 1.2 | 0.28 | 0.71 |
| 3 | 1.1 | — | 0.92 | 1.08 | 0.75 | 1.1 | 0.75 | 1.0 |
| 4 | 0.80 | 0.86 | 0.75 | 0.76 | 0.76 | 0.98 | 0.90 | 1.1 |
| 5 | 0.86 | 1.2 | 1.0 | 0.81 | 0.81 | 0.84 | 0.94 | 0.91 |
| 6 | 0.75 | 0.85 | 0.85 | 0.85 | 0.82 | 0.94 | 1.0 | 1.0 |
| 7 | 0.55 | 1.0 | 0.67 | 0.79 | 0.84 | 0.72 | 1.2 | 1.0 |
| 8 | 0.90 | 0.78 | 1.1 | 0.85 | — | 0.65 | 1.0 | 0.62 |
| Average $\Delta T$ | 0.82° C. | 0.93° C. | 0.82° C. | 0.82° C. | 0.86° C. | 0.90° C. | 0.84° C. | 0.88° C. |
| Standard Deviation | 0.15 | 0.16 | 0.23 | 0.11 | 0.13 | 0.18 | 0.27 | 0.17 |
| % Enhancement* | 41% | 34% | 41% | 41% | 39% | 36% | 40% | 37% |

*$\Delta T$ for untreated surface is 1.4° C.

EXAMPLE II

In order to simplify the heat treatment process, air cooling was substituted for the water quenching step with no apparent problems. Only test pieces from two of the heats were tested and the results are given in Table II.

TABLE II

Heat Transfer Enhancement of Aluminum Alloy 3003 Test Pieces Solution Heat Treated at 1100° F. for ½ Hour and Air Cooled Etched in Dilute Mixed Acid Solution for 10 Minutes

| Heat No. | 3 | 4 |
|---|---|---|
| Thermocouple | $\Delta T$ at 0.4 w/cm$^2$ | |
| 1 | 1.01° C. | 0.95° C. |
| 2 | 1.04 | 0.49 |
| 3 | 0.71 | 0.54 |
| 4 | 0.63 | 0.38 |
| 5 | 0.33 | 0.64 |
| 6 | 1.07 | 0.44 |
| 7 | 0.84 | 0.25 |
| 8 | 0.69 | 0.48 |
| Average $\Delta T$ | 0.79° C. | 0.52° C. |
| Standard Deviation | 0.25 | 0.21 |

TABLE II-continued

Heat Transfer Enhancement of Aluminum Alloy 3003 Test Pieces Solution Heat Treated at 1100° F. for ½ Hour and Air Cooled Etched in Dilute Mixed Acid Solution for 10 Minutes

| Heat No. | 3 | 4 |
|---|---|---|
| % Enhancement* | 44% | 63% |

*ΔT for untreated surface is 1.4° C.

COMPARATIVE EXAMPLE III

Test pieces of aluminum alloy 3003 were etched in acid solution without a prior laboratory heat treatment to develop precipitates. No enhanced heat transfer behavior was obtained from these etched surfaces. In comparison, test pieces of aluminum alloy 3003 after shaping into a fin type heat exchanger by normal fabrication techniques, and later subjected to etching, exhibited enhanced heat transfer behavior without a separate heat treatment.

COMPARATIVE EXAMPLE IV

Following the success of the heat treating and acid etching procedures, test pieces were prepared to determine if a heat treatment alone could produce enhanced heat transfer behavior. However, no differences in ΔT between the heat treated test pieces and the as-received test pieces were found.

EXAMPLE V

Brazed Fin Test Pieces

To evaluate the enhancement procedures on finned material, test pieces with both untreated and treated (½ hour at 1100° F., air cooled, and etched for 10 minutes in our dilute mixed acid) corrugated fins were prepared with aluminum alloy 3003. The fins were fabricated of 0.010 inch thick sheet and were ¼ inch high with 15 fins per inch. The test pieces consisted of an 8 inch by 2 inch wide piece of corrugated fin with a ¼ inch square, 8 inch long aluminum alloy 3003 bar on either side sandwiched between two ¼ inch thick plates of aluminum alloy 3003 8 inch long by 2½ inch wide. The assembly was vacuum brazed using 0.020 inch thick No. 8 brazing sheet (aluminum alloy 3003 core with an aluminum alloy 4004 cladding).

The fixture for the test pieces was fabricated from glass fiber reinforced epoxy, the same material used for fixturing the flat plate test pieces. The test piece was placed in the fixture with a strip heater (Minco HK 5427R9.4213A) on either side. CRYO-CON thermally conductive grease was used between the heaters and test piece to insure good thermal contact. The test piece was sealed in the fixture with RTV, a room temperature vulcanizing silicone sealant so that only the fin section was exposed to liquid nitrogen into which the structure was immersed for testing. The temperature difference between the aluminum fins and the boiling nitrogen was measured as a function of power input to the heaters at nine equally spaced (approximately 0.8 inch) positions with copper-constantan differential thermocouples.

Measurements of ΔT versus power input were made on both a test piece with a treated fin and one which was not treated and served as a control. The heat transfer enhancement exhibited by the treated test pieces was about 40% which compares favorably to the 40–50% enhancement generally found in the flat plate test pieces.

EXAMPLE VII

Heat Transfer to Flowing Water

The above experiments demonstrated the improved heat transfer between a metal surface and a boiling cryogen. This heat transfer involved a phase change in the cryogen from the liquid to gaseous state. In an effort to determine the applicability of the invention to systems that do not involve phase changes, heat transfer measurements were made to flowing water at room temperature.

A test specimen of aluminum alloy 3003 approximately twelve inch long 3/16 inch wide by 0.010 inch thick was placed in a hollow plastic tube, that had a ⅜ inch bore. Electrical contacts were made with mechanical clamps to each end of the aluminum strip. Power to the test piece was supplied by a 10V–120A DC power supply. Deionized water (approximately 18 megohm resistivity) was gravity fed through the tube at measured flow rates. A differential thermocouple was used to measure the differences between the inlet and outlet water temperature. ΔT measurements were made as a function of power input on an untreated aluminum alloy 3003 test piece at two different water flow rates. The aluminum strip was then removed, heat treated and etched to provide an enhanced heat transfer surface; and returned to the ΔT measurement apparatus. The data points are generally on a straight line and yield the following information:

| Flow Rate | Untreated test piece | Enhanced Sample |
|---|---|---|
| 103 cc/min | 0.16° C./watt | 0.21° C./watt |
| 143 cc/min | 0.14° C./watt | 0.18° C./watt |

The heat treated and etched samples showed an apparent 30% improvement in heat transfer properties.

We claim:

1. A heat exchanger wall for transferring heat to a boiling liquid in a heat exchange apparatus which comprises a boiling surface comprised of an aluminum alloy having nucleation site pits formed on said surface by etching a precipitate therein, wherein said nucleation site pits entrap vapor bubbles to provide nucleation sites, the nucleation site pits having an average size to 0.5 to 5 microns.

2. The heat exchanger wall of claim 1, wherein said heat exchanger wall is part of a fin type heat exchanger.

3. The heat exchanger wall of claim 1, wherein the density of said pits are in the range of $10^4$ to $10^6$ per square centimeter.

* * * * *